US011214463B2

(12) United States Patent
Siikonen et al.

(10) Patent No.: US 11,214,463 B2
(45) Date of Patent: Jan. 4, 2022

(54) PEAK TRAFFIC DETECTION ACCORDING TO PASSENGER TRAFFIC INTENSITY

(71) Applicant: KONE Corporation, Helsinki (FI)

(72) Inventors: Marja-Liisa Siikonen, Helsinki (FI); Juha-Matti Kuusinen, Helsinki (FI); Mirko Ruokokoski, Helsinki (FI); Henri Hakonen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 515 days.

(21) Appl. No.: 16/268,245

(22) Filed: Feb. 5, 2019

(65) Prior Publication Data

US 2019/0168992 A1 Jun. 6, 2019

Related U.S. Application Data

(63) Continuation of application No. PCT/EP2016/070392, filed on Aug. 30, 2016.

(51) Int. Cl.

| | |
|---|---|
| ***B66B 1/28*** | (2006.01) |
| ***B66B 1/34*** | (2006.01) |
| ***B66B 1/20*** | (2006.01) |
| ***B66B 5/00*** | (2006.01) |

(52) U.S. Cl.

CPC ..... *B66B 1/28* (2013.01); *B66B 1/20* (2013.01); *B66B 1/34* (2013.01); *B66B 5/0012* (2013.01); *B66B 2201/403* (2013.01)

(58) Field of Classification Search

CPC ..... B66B 1/28; B66B 2201/211; B66B 2201/222; B66B 1/2408; B66B 2201/403; B66B 2201/402; B66B 1/3415; B66B 5/0012; B66B 2201/212; B66B 5/0018; B66B 2201/225; B66B 1/3492

See application file for complete search history.

(56) References Cited

U.S. PATENT DOCUMENTS

| | | | | | |
|---|---|---|---|---|---|
| 4,838,384 | A * | 6/1989 | Thangavelu | B66B 1/2458 | 187/385 |
| 5,022,497 | A * | 6/1991 | Thanagavelu | B66B 1/2458 | 187/382 |
| 5,035,302 | A * | 7/1991 | Thangavelu | B66B 1/2408 | 187/382 |
| 5,168,133 | A * | 12/1992 | Bahjat | B66B 1/2408 | 187/247 |
| 5,183,981 | A * | 2/1993 | Thangavelu | B66B 1/2408 | 187/380 |
| 5,241,142 | A * | 8/1993 | Thangavelu | B66B 1/2408 | 187/385 |
| 5,511,635 | A | 4/1996 | Kameli | | |

(Continued)

*Primary Examiner* — Marlon T Fletcher

(74) *Attorney, Agent, or Firm* — Birch, Stewart, Kolasch & Birch, LLP

(57) ABSTRACT

A method and a control device for controlling an at least one elevator are described, by which an arriving traffic intensity is detected, the traffic intensity being a number of passengers arriving at the at least one elevator during a traffic intensity determination period, a traffic amount value is determined by comparing the traffic intensity to a maximum building population, wherein the maximum building population is a maximum number of people in a building, and the at least one elevator is controlled based on the determined traffic amount value.

20 Claims, 2 Drawing Sheets

(56) References Cited

U.S. PATENT DOCUMENTS

| | | | | |
|---|---|---|---|---|
| 5,750,946 | A * | 5/1998 | Thangavelu | B66B 1/2458 187/382 |
| 5,767,462 | A * | 6/1998 | Thangavelu | B66B 1/2458 187/382 |
| 2006/0131109 | A1* | 6/2006 | Hawkins | B66B 11/007 187/392 |
| 2010/0236870 | A1* | 9/2010 | Kostka | B66B 5/021 187/281 |
| 2012/0020518 | A1* | 1/2012 | Taguchi | G06T 7/292 382/103 |
| 2013/0133986 | A1* | 5/2013 | De Vincentis | G01S 13/82 187/380 |
| 2015/0034426 | A1* | 2/2015 | Armistead | B66B 5/0037 187/392 |
| 2015/0344265 | A1* | 12/2015 | Hakonen | H04B 17/318 187/392 |
| 2016/0347577 | A1* | 12/2016 | Simcik | B66B 1/3415 |
| 2017/0233220 | A1* | 8/2017 | Scoville | G06Q 10/0631 705/7.29 |
| 2019/0002234 | A1* | 1/2019 | Shinohe | B66B 1/28 |
| 2019/0168992 | A1* | 6/2019 | Siikonen | B66B 1/28 |
| 2019/0359449 | A1* | 11/2019 | Schmidt | B66B 3/008 |
| 2020/0102186 | A1* | 4/2020 | Pahlke | B66B 1/468 |
| 2020/0299099 | A1* | 9/2020 | Hatori | B66B 3/00 |
| 2020/0307950 | A1* | 10/2020 | Sudi | B66B 1/3476 |
| 2021/0155452 | A1* | 5/2021 | Hsu | B66B 1/3476 |

* cited by examiner

PEAK TRAFFIC DETECTION ACCORDING TO PASSENGER TRAFFIC INTENSITY

CROSS REFERENCE TO RELATED APPLICATIONS

This application is a Continuation of PCT International Application No. PCT/EP2016/070392, filed on Aug. 30, 2016, which is hereby expressly incorporated by reference into the present application.

FIELD OF THE INVENTION

The present invention relates to an apparatus, a method and a computer program product for controlling at least one elevator wherein peak traffic is detected according to passenger traffic intensity.

RELATED BACKGROUND ART

The following description of background art and examples may include insights, discoveries, understandings or disclosures, or associations, together with disclosures not known to the relevant prior art, to at least some examples of embodiments of the present invention but provided by the invention. Some of such contributions of the invention may be specifically pointed out below, whereas other of such contributions of the invention will be apparent from the related context.

Some examples of the present disclosure relate to control of elevators, for example a group of elevators. For controlling elevators and in particular a group of elevators, it is helpful to recognize traffic peaks. According to the prior art, traffic peaks are recognized from the people flow intensity, calls and loads.

Typically, traffic intensities are divided into LIGHT, NORMAL, HEAVY traffic levels. Depending on traffic direction, also different traffic modes can be identified (incoming, outgoing, interfloor).

A known method to identify traffic levels is to compare arriving traffic intensity (=arriving people count in 5 minutes to be served by elevators) to the maximum handling capacity of an elevator group (maximum number of served people in 5 minutes). For example if traffic intensity is ≥80% of the maximum handling capacity, this would mean that the traffic level is HEAVY traffic level.

However, by comparing the traffic intensity to the maximum handling capacity of an elevator or a group of elevators, the traffic peaks are often not detected when the buildings have a sufficient handling capacity.

This leads to a problem that there might be situations in which during traffic peaks, which are not recognized, the elevators may not be operated such that the passengers can be quickly transported, or that during non-peak times elevators are unnecessarily operated in a high load state, even though a low load state would be possible. That is, there may occur situations in which energy is wasted.

SUMMARY OF THE INVENTION

Thus, it is an object of the present invention to overcome these disadvantages and to provide a method and a device for controlling at least one elevator, in which the traffic intensity is detected more reliably.

According to a first aspect of the present invention a method for controlling an at least one elevator is provided which comprises detecting an arriving traffic intensity, the traffic intensity being a number of passengers arriving at the at least one elevator during a traffic intensity determination period, determining a traffic amount value by comparing the traffic intensity to a maximum building population, wherein the maximum building population is a maximum number of people in a building, and controlling the at least one elevator based on the determined traffic amount value.

According to a second aspect of the present invention, a control device for controlling an elevator is provided, wherein the control device comprises a controller configured to detect an arriving traffic intensity, the traffic intensity being a number of passengers arriving at the at least one elevator during a traffic intensity determination period, determine a traffic amount value by comparing the traffic intensity to a maximum building population, wherein the maximum building population is a maximum number of people in a building, and control the at least one elevator based on the determined traffic amount value.

The first and second aspects may be modified as follows:

The traffic amount value may be a value which indicates a percentage of the detected traffic intensity to the maximum building population.

The traffic amount value may be a traffic level which indicates a range of percentages of the detected traffic intensity to the maximum building population.

Furthermore, persons arriving into the building from entrance floors and persons leaving the building from the entrance floors may be detected, the number of detected persons arriving into the building from the entrance floors may be added to a basic building population number, the number of detected persons leaving the building from the entrance floors may be subtracted from the basic building population number, and a maximum number of the basic building population number during a building population determination period may be determined as the maximum building population.

Moreover, the maximum building population may be updated for each building population determination period.

The maximum building population may be updated by using a smoothing method.

The number of persons arriving into or leaving the building may be detected by using a weighting device and/or a light sensor and/or a camera based system.

The building population determination period may be longer than the traffic intensity determination period.

Moreover, a group of elevators may be controlled, and the group of elevators may be controlled based on the determined traffic amount value.

In addition, according to another aspect of the present invention, there is provided a computer program product for a computer, including software code portions for performing the steps of the above defined methods, when said product is run on the computer. The computer program product may include a computer-readable medium on which said software code portions are stored. Furthermore, the computer program product may be directly loadable into the internal memory of the computer or transmittable via a network by means of at least one of upload, download and push procedures.

According to a still further aspect, a control device for controlling an at least one elevator is provided which comprises means for detecting an arriving traffic intensity, the traffic intensity being a number of passengers arriving at the at least one elevator during a traffic intensity determination period, means for determining a traffic amount value by comparing the traffic intensity to a maximum building population, wherein the maximum building population is a maximum number of people in a building, and means for controlling the at least one elevator based on the determined traffic amount value.

The apparatus according to this aspect may be modified similar as the first aspect described above.

BRIEF DESCRIPTION OF THE DRAWINGS

These and other objects, features, details and advantages will become more fully apparent from the following detailed description of embodiments of the present invention which is to be taken in conjunction with the appended drawings, in which.

DETAILED DESCRIPTION OF EMBODIMENTS

In the following, description will be made to embodiments of the present invention. It is to be understood, however, that the description is given by way of example only, and that the described embodiments are by no means to be understood as limiting the present invention thereto.

It is to be noted that the following examples and embodiments are to be understood only as illustrative examples. Although the specification may refer to "an", "one", or "some" example(s) or embodiment(s) in several locations, this does not necessarily mean that each such reference is related to the same example(s) or embodiment(s), or that the feature only applies to a single example or embodiment. Single features of different embodiments may also be combined to provide other embodiments. Furthermore, terms like "comprising" and "including" should be understood as not limiting the described embodiments to consist of only those features that have been mentioned; such examples and embodiments may also contain features, structures, units, modules etc. that have not been specifically mentioned.

The general elements and functions of described elevator systems, details of which also depend on the actual type of elevator system, are known to those skilled in the art, so that a detailed description thereof is omitted herein. However, it is to be noted that several additional devices and functions besides those described below in further detail may be employed in an elevator system.

Figure 1:
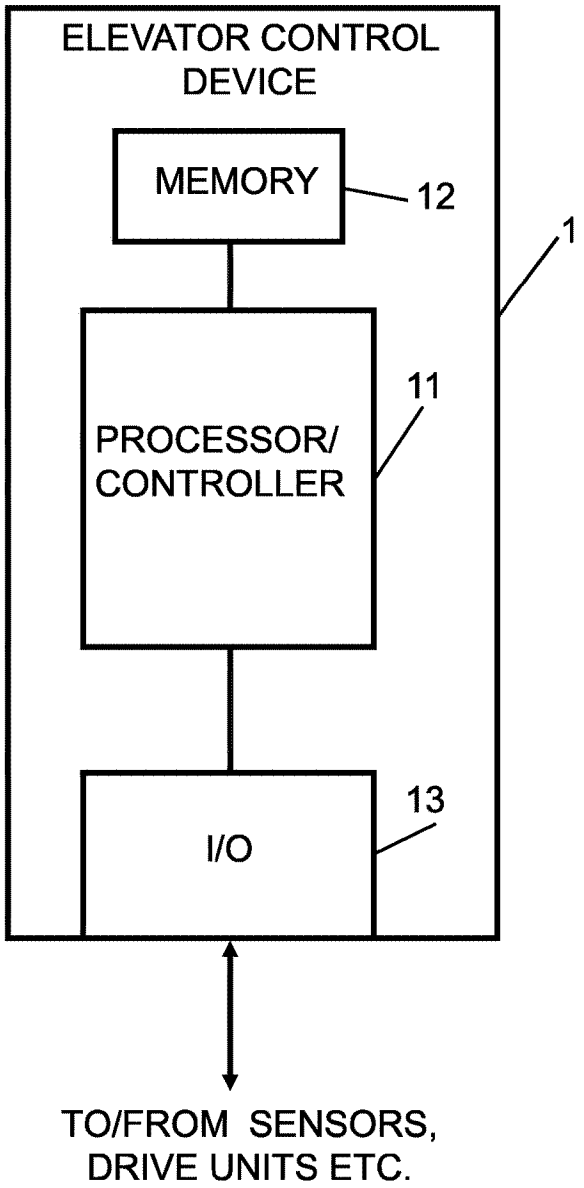
FIG. 1 shows an elevator control apparatus according to some embodiments of the present invention.

FIG. 1 shows a schematic diagram illustrating a configuration of an elevator control device 1 where some examples of embodiments are implementable. In particular, the elevator control device comprises a processor or controller 11. The elevator control device may further comprise a memory 12 in which programs to be carried out and data required are stored, and input/output units 13, via which control signals may be transmitted to other control units, elevator drives etc., and/or signals from sensors or other control units etc. may be received.

Figure 2:
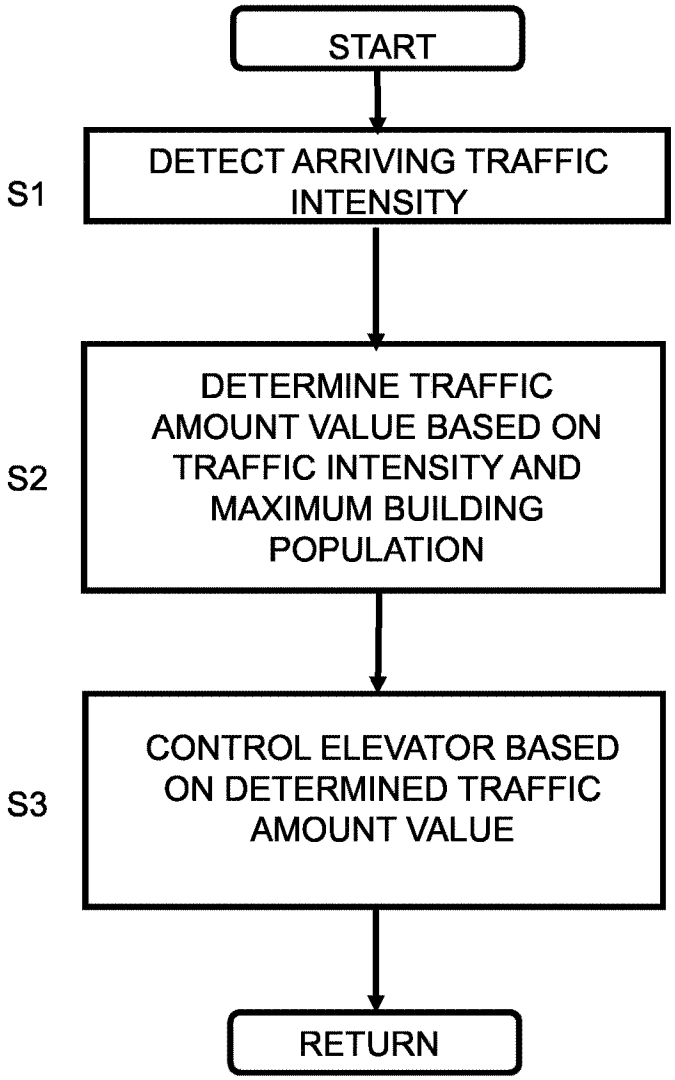
FIG. 2 shows a method for controlling an elevator according to an embodiment of the present invention.

The controller 11 shown in FIG. 1 may be configured to carry out a method as illustrated in FIG. 2.

In step S1, an arriving traffic intensity is detected. The arriving traffic intensity is a number of passengers arriving at the at least one elevator during a traffic intensity determination period. In step S2, a traffic amount value is determined by comparing the traffic intensity to a maximum building population, wherein the maximum building population is a maximum number of people in a building. In step S3, the at least one elevator is controlled based on the determined traffic amount value.

Hence, according to the present invention, the traffic intensity is scaled to the building population. In this way, peak traffic can be detected more reliably. Thus, it is possible to correspondingly control the at least one elevator accurately, i.e. such that operation modes requiring a large amount of energy are only applied when necessary.

The traffic amount value may be a value which indicates a percentage of the detected traffic intensity to the maximum building population. Alternatively, the traffic amount value is a traffic level which indicates a range of percentages of the detected traffic intensity to the maximum building population. Examples for traffic levels may include "HEAVY", "NORMAL", "Light" etc. For example, the traffic level may be "HEAVY" when the percentage is equal to or higher than 5%.

The traffic intensity determination period mentioned above may be a short period which is sufficient to detect a change in the arriving traffic intensity. For example, traffic intensity determination period may be less than an hour, and preferably in the order of a few minutes (e.g. 5 minutes).

Thus, according to embodiments of the present invention, the problem is solved that traffic peaks come on in the building at right times. This means up-peak comes on when the control system recognizes that now the traffic intensity i.e. passenger arrival rate, is above the normal level.

As mentioned above, according to embodiments of the present invention, the traffic intensity is scaled to the building population. The building population can be estimated from the accumulated passenger information. Passengers are counted by the lift group e.g. by load weighing device and curtain of lights, also camera based systems are possible. People arriving into the building from entrance floors are constantly added in building population and people leaving the building from the entrances are subtracted from the population. The maximum number of occupants in the building during the day is the building population. The counting starts e.g. from midnight.

Counting is done for each day. The building population can be updated each day e.g. using a smoothing method (exponential smoothing).

In other words, persons arriving into the building from entrance floors and persons leaving the building from the entrance floors may be detected. The number of detected persons arriving into the building from the entrance floors is added to a basic building population number, and the number of detected persons leaving the building from the entrance floors is subtracted from the basic building population number. The maximum number of the basic building population number during a building population determination period is determined as the maximum building population.

The above building population determination period may be one day, as in the example given above, but may also be a plurality of days or any suitable duration, which, however, should be sufficiently longer than the traffic intensity determination period described above.

At the start of each building population determination period (i.e., when the above described procedure for determining the maximum building population is started), the basic building population number may be reset to zero.

Thus, according to embodiments of the present invention, the peak traffic is scaled to the building population, not to the performance of lifts. This guarantees that peak traffic is detected more easily than earlier. Peak traffic comes on with heavy traffic compared to the normal level of traffic in the building.

Therefore, peak traffic can be predicted more reliably. Thus, a corresponding control of the elevator or elevator group can be carried out.

In other words, according to embodiments of the present invention, arriving traffic intensity is compared with X % of maximum building population/day (i.e. not with handling capacity). For example if arriving traffic intensity is equal to or larger than 5% of maximum building population, such a traffic would be determined as a HEAVY traffic level. When the arriving traffic intensity is between 2-5% of the maximum building population, then such a traffic would be determined as a NORMAL traffic level. When the arriving traffic intensity is equal to or below 2%, such a traffic would be determined as a LIGHT traffic level.

Depending on detected traffic level, elevator group control is adapted accordingly (specifically call allocation), for example LIGHT traffic level try to save energy, in HEAVY traffic calls are served as fast as possible.

For example, during peak traffic, the velocity of the elevators may be set higher than during medium or low traffic. Alternatively, in case of an elevator group, during low traffic, one or more of the elevators of the elevator group may be set into a standby state.

Embodiments of the present invention are not limited to the details of the embodiments as described above, and various modifications are possible.

For example, in the above embodiment it was described that the maximum building population is determined by the elevators themselves. However, alternatively it is also possible to determine the maximum building population by photoelectric sensors, curtain of lights, cameras etc. provided at entrances of the building itself. Moreover, for example in an office building in which a certain number of office workers are employed and there is negligible amount of public business, the maximum building population can be determined based on the number of office workers in this building.

It is to be understood that any of the above modifications can be applied singly or in combination to the respective aspects and/or embodiments to which they refer, unless they are explicitly stated as excluding alternatives.

Furthermore, elevator system elements, in particular operation elements, control elements (e.g., the elevator control device 1) or detection elements, as well as corresponding functions as described herein, and other elements, functions or applications may be implemented by software, e.g. by a computer program product for a computer, and/or by hardware. For executing their respective functions, correspondingly used devices, elements or functions may include several means, modules, units, components, etc. (not shown) which are required for control, processing and/or communication/signaling functionality. Such means, modules, units and components may include, for example, one or more processors or processor units including one or more processing portions for executing instructions and/or programs and/or for processing data, storage or memory units or means for storing instructions, programs and/or data, for serving as a work area of the processor or processing portion and the like (e.g. ROM, RAM, EEPROM, and the like), input or interface means for inputting data and instructions by software (e.g. floppy disc, CD-ROM, EEPROM, and the like), a user interface for providing monitor and manipulation possibilities to a user (e.g. a screen, a keyboard and the like), other interface or means for establishing links and/or connections under the control of the processor unit or portion (e.g. wired and wireless interface means etc.) and the like. It is to be noted that in the present specification processing portions should not be only considered to represent physical portions of one or more processors, but may also be considered as a logical division of the referred processing tasks performed by one or more processors.

For the purpose of the present invention as described herein above, it should be noted that embodiments suitable to be implemented as software code or portions of it and being run using a processor or processing function are software code independent and can be specified using any known or future developed programming language, such as a high-level programming language, such as objective-C, C, C++, C#, Java, Python, Javascript, other scripting languages etc., or a low-level programming language, such as a machine language, or an assembler.

implementation of embodiments is hardware independent and may be implemented using any known or future developed hardware technology or any hybrids of these, such as a microprocessor or CPU (Central Processing Unit), MOS (Metal Oxide Semiconductor), CMOS (Complementary MOS), BiMOS (Bipolar MOS), BiCMOS (Bipolar CMOS), ECL (Emitter Coupled Logic), and/or TTL (Transistor-Transistor Logic).

embodiments may be implemented as individual devices, apparatuses, units, means or functions, or in a distributed fashion, for example, one or more processors or processing functions may be used or shared in the processing, or one or more processing sections or processing portions may be used and shared in the processing, wherein one physical processor or more than one physical processor may be used for implementing one or more processing portions dedicated to specific processing as described, a device may be implemented by a semiconductor chip, a chipset, or a (hardware) module including such chip or chipset;

embodiments may also be implemented as any combination of hardware and software, such as ASIC (Application Specific IC (Integrated Circuit)) components, FPGA (Field-programmable Gate Arrays) or CPLD (Complex Programmable Logic Device) components or DSP (Digital Signal Processor) components.

embodiments may also be implemented as computer program products, including a computer usable medium having a computer readable program code embodied therein, the computer readable program code adapted to execute a process as described in embodiments, wherein the computer usable medium may be a non-transitory medium.

Although the present invention has been described herein before with reference to particular embodiments thereof, the present invention is not limited thereto and various modifications can be made thereto.

According to some embodiments of the present invention, a method and a control device for controlling an at least one elevator are described, by which an arriving traffic intensity is detected (S1), the traffic intensity being a number of passengers arriving at the at least one elevator during a traffic intensity determination period, a traffic amount value is determined by comparing the traffic intensity to a maximum building population (S2), wherein the maximum building population is a maximum number of people in a building, and the at least one elevator is controlled based on the determined traffic amount value (S3).

The invention claimed is:

1. A method for controlling an at least one elevator comprising detecting an arriving traffic intensity, the traffic intensity being a number of passengers arriving at the at least one elevator during a traffic intensity determination period, determining a traffic amount value by comparing the traffic intensity to a maximum building population, wherein the maximum building population is a maximum number of people in a building, and controlling the at least one elevator based on the determined traffic amount value, wherein the method further comprises, detecting persons arriving into the building from entrance floors and persons leaving the building from the entrance floors, adding the number of detected persons arriving into the building from the entrance floors to a basic building population number, subtracting the number of detected persons leaving the building from the entrance floors from the basic building population number, determining a maximum number of the basic building population number during a building population determination period as the maximum building population, and updating the maximum building population for each building population determination period.

2. The method according to claim 1, wherein the traffic amount value is a value which indicates a percentage of the detected traffic intensity to the maximum building population.

3. The method according to claim 1, wherein the traffic amount value is a traffic level which indicates a range of percentages of the detected traffic intensity to the maximum building population.

4. The method according to claim 1, wherein the maximum building population is updated by using a smoothing method.

5. The method according to claim 1, further comprising detecting the number of persons arriving into or leaving the building by using a weighting device and/or a light sensor and/or a camera based system.

6. The method according to claim 1, wherein the building population determination period is longer than the traffic intensity determination period.

7. The method according to claim 1, wherein a group of elevators is controlled, and the group of elevators is controlled based on the determined traffic amount value.

8. A computer program product comprising code means for performing a method according to claim 1 when run on a processing means or module.

9. The computer program product according to claim 8, wherein the computer program product is embodied on a computer-readable medium, and/or the computer program product is directly loadable into the internal memory of the computer and/or transmittable via a network by means of at least one of upload, download and push procedures.

10. The method according to claim 2, wherein the traffic amount value is a traffic level which indicates a range of percentages of the detected traffic intensity to the maximum building population.

11. The method according to claim 2, further comprising detecting the number of persons arriving into or leaving the building by using a weighting device and/or a light sensor and/or a camera based system.

12. The method according to claim 3, further comprising detecting the number of persons arriving into or leaving the building by using a weighting device and/or a light sensor and/or a camera based system.

13. The method according to claim 4, further comprising detecting the number of persons arriving into or leaving the building by using a weighting device and/or a light sensor and/or a camera based system.

14. A control device for controlling at least one elevator, wherein the control device comprises a controller configured to detect an arriving traffic intensity, the traffic intensity being a number of passengers arriving at the at least one elevator during a traffic intensity determination period, determine a traffic amount value by comparing the traffic intensity to a maximum building population, wherein the maximum building population is a maximum number of people in a building, and control the at least one elevator based on the determined traffic amount value, wherein the controller is further configured to detect persons arriving into the building from entrance floors and persons leaving the building from the entrance floors, add the number of detected persons arriving into the building from the entrance floors to a basic building population number, subtract the number of detected persons leaving the building from the entrance floors from the basic building population number, determine a maximum number of the basic building population number during a building population determination period as the maximum building population, and update the maximum building population for each building population determination period.

15. The control device according to claim 14, wherein the traffic amount value is a value which indicates a percentage of the detected traffic intensity to the maximum building population.

16. The control device according to claim 14, wherein the traffic amount value is a traffic level which indicates a range of percentages of the detected traffic intensity to the maximum building population.

17. The control device according to claim 14, wherein the controller is further configured to update the maximum building population by using a smoothing method.

18. The control device according to claim 14, wherein the controller is further configured to detect the number of persons arriving into or leaving the building by using a weighting device and/or a light sensor and/or a camera based system.

19. The control device according to claim 14, wherein the building population determination period is longer than the traffic intensity determination period.

20. The control device according to claim 14, wherein a group of elevators is controlled, and the group of elevators is controlled based on the determined traffic amount value.

* * * * *